US007121114B2

(12) United States Patent
Förster et al.

(10) Patent No.: US 7,121,114 B2
(45) Date of Patent: Oct. 17, 2006

(54) CONDENSER

(75) Inventors: Uwe Förster, Dresden (DE); Kurt Molt, Bietigheim-Bissingen (DE); Gerrit Wölk, Stuttgart (DE)

(73) Assignee: Behr GmbH & Co., KG, Stuttgart (DE)

( * ) Notice: Subject to any disclaimer, the term of this patent is extended or adjusted under 35 U.S.C. 154(b) by 106 days.

(21) Appl. No.: 10/508,782

(22) PCT Filed: Mar. 24, 2003

(86) PCT No.: PCT/EP03/03043

§ 371 (c)(1),
(2), (4) Date: Sep. 23, 2004

(87) PCT Pub. No.: WO03/081148

PCT Pub. Date: Oct. 2, 2003

(65) Prior Publication Data

US 2005/0103047 A1 May 19, 2005

(30) Foreign Application Priority Data

Mar. 23, 2002 (DE) ..... 102 13 175
Feb. 13, 2003 (DE) ..... 103 06 192

(51) Int. Cl.
*F25B 39/04* (2006.01)

(52) U.S. Cl. ..... 62/509; 62/283

(58) Field of Classification Search ..... 62/509, 62/85, 92, 283
See application file for complete search history.

(56) References Cited

U.S. PATENT DOCUMENTS

| | | | |
|---|---|---|---|
| 5,537,839 | A | 7/1996 | Burk et al. |
| 5,666,791 | A | 9/1997 | Burk |
| 5,992,174 | A | 11/1999 | Mittelstrass |
| 6,446,714 | B1 | 9/2002 | Kaspar et al. |

FOREIGN PATENT DOCUMENTS

| | | | |
|---|---|---|---|
| DE | 42 38 853 | A1 | 5/1994 |
| DE | 197 12 714 | A1 | 10/1998 |
| DE | 198 48 744 | A1 | 4/2000 |
| DE | 199 43 422 | A1 | 3/2001 |
| EP | 0 669 506 | A1 | 8/1995 |
| EP | 1 079 186 | A1 | 2/2001 |
| EP | 1 104 879 | A1 | 6/2001 |
| EP | 1 132 695 | A1 | 9/2001 |
| EP | 1 202 007 | A1 | 5/2002 |
| EP | 1 319 908 | A1 | 6/2003 |
| JP | 2001-41612 | A | 2/2001 |
| JP | 2001-304725 | A | 10/2001 |

*Primary Examiner*—Melvin Jones
(74) *Attorney, Agent, or Firm*—Foley & Lardner LLP

(57) ABSTRACT

The invention relates to for a motor vehicle air conditioning installation, comprising a pipe/rib block, headers which are arranged on both sides thereof and are used to receive the ends of the pipes, and a collector which is arranged parallel to one of the headers, is fluidically connected to the adjacent header via openings, and respectively comprises a closing element and receives a dryer/filter cartridge on the front side, said cartridge being fixed in the header and comprising a peripheral sealant which is arranged between the openings.

21 Claims, 7 Drawing Sheets

CONDENSER

Figure 1:
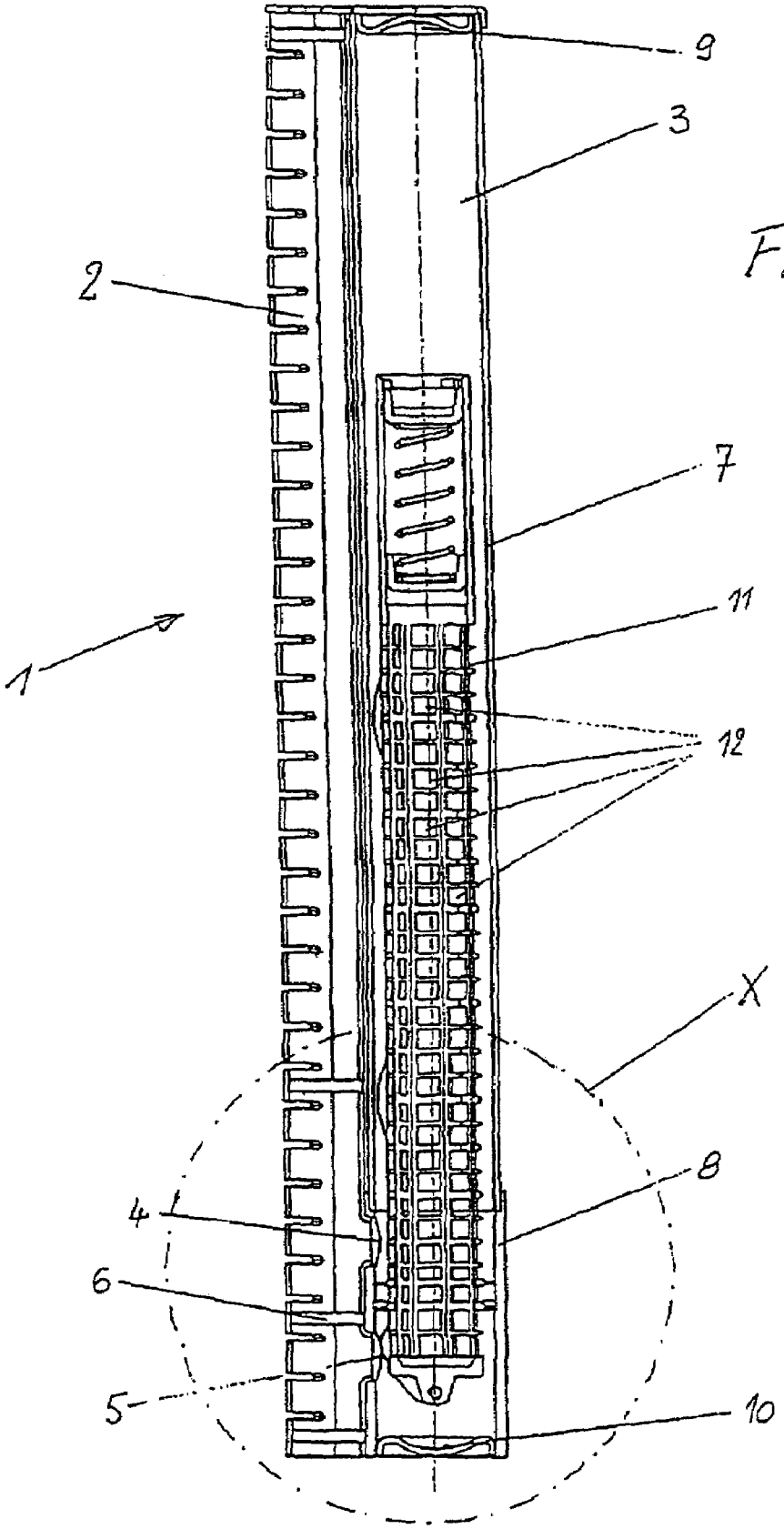

The invention relates to a condenser, and also to a method for manufacturing a condenser.

According to the condenser known from DE-A 197 12 714, a dryer/filter cartridge is inserted, after the soldering process, into the collector of the condenser, positioned there, and the collector is then closed off in a pressure-tight fashion by means of a screwable lid. The dryer/filter cartridge is embodied as a plastic injection molded part because it is not subjected to the high temperatures of the soldering process, and is connected to the closure lid by a clip connection, and as a result the dryer/filter cartridge can be mounted together with the closure lid and also replaced together with the closure lid in the case of a repair or maintenance.

The design and the function of such a condenser or condenser mode in which the collector is integrated into the condenser are described in more detail in DE-A 42 38 853 by the applicant. The disclosed content in this publication is herewith expressly incorporated in the disclosed content of the present application. Said publication has already disclosed an embodiment in which the dryer cartridge cannot be removed from the collector. There is no information about the attachment of the dryer cartridge in the collector.

In the course of the further development of such a soldered coolant condenser, EP-A 1 079 186 has also proposed a dryer insert which cannot be replaced and which is inserted into the collector of the condenser after it has been soldered and is subsequently closed off by a lid by means of a welded connection. Such a dryer therefore cannot be replaced in a nondestructive fashion. This dryer insert is attached to a disk with a shaft-shaped support, the circumference of the disk forming a clamped fit with the inner wall of the collector. As a result of this only frictionally locking securement of the dryer insert, the dryer insert is not positioned or attached in a clearly defined way but instead can carry out movements within the collector, in particular as a result of vibrations due to the vehicle in which it is installed, which leads to undesired abrasion and noise.

The object of the present invention is to improve a condenser of the type mentioned at the beginning to the effect that it can be manufactured cost effectively and that, in particular the dryer/filter cartridge is positioned in the collector using simple means.

The dryer/filter cartridge is positioned with respect to the collector by means of a securing means which is easy to manufacture and is arranged at the circumference. This provides the advantage that after the condenser has been soldered the cartridge can easily be inserted into the collector through the open end side and pushed in until the securing means, which is preferably embodied as a circumferential or interrupted securing rib, engages or latches in a corresponding depression in the collector. The securing means can however also be formed by a plurality of fingers or projecting elements which are distributed along the circumference. The depression can be embodied here as an annular groove or as a bead in the pipe. The depression can also be embodied as a plurality of individual depressions.

When the cartridge is pushed in, the securing rib is preferably firstly deformed elastically until it reaches the depression in the collector and clicks into it. The cartridge is thus positioned and secured in the collector. The collector is then closed off in a nondetachable fashion by a lid, i.e. soldered, welded or bonded or closed off by a detachable stopper. The securing means in the form of a circumferential or interrupted securing rib can be attached to the plastic housing of the cartridge by injection molding and thus does not entail any additional fabrication expenditure.

In one advantageous development of the invention, the collector is composed of two parts, specifically a thin-walled pipe, manufactured from commercially available welded piping, and of an extruded profiled element, which can be processed by cutting. This profiled element therefore has not only the two overflow openings but also an annular groove which is formed in the inner wall and into which the securing rib clicks, thus ensuring the positioning of the cartridge in the collector.

According to one advantageous development of the invention, the securing means is embodied as an additional component in the form of an annular spring element which is secured to the cartridge at one end and is inserted by compression into the depression (annular groove or bead) in the collector at the other end, thus positioning the cartridge in the collector. The annular spring element may be a standard part which is secured axially to the cartridge, for example is inserted into an annular groove (in the manner of a piston ring) in the cartridge. This annular spring element positions the cartridge in the collector in a particularly secure way.

In an advantageous development of the invention there is provision for both the sealing lip and the securing rib to be embodied as one and the same part which is attached to the cartridge and is preferably embodied as a single-piece plastic injection molded part. This combined sealing and securing means in the form of a circumferential, elastically deformable lip is arranged between the two overflow openings in order to be able to fulfill its sealing function between the upper and lower parts of the collector.

Figure 2:
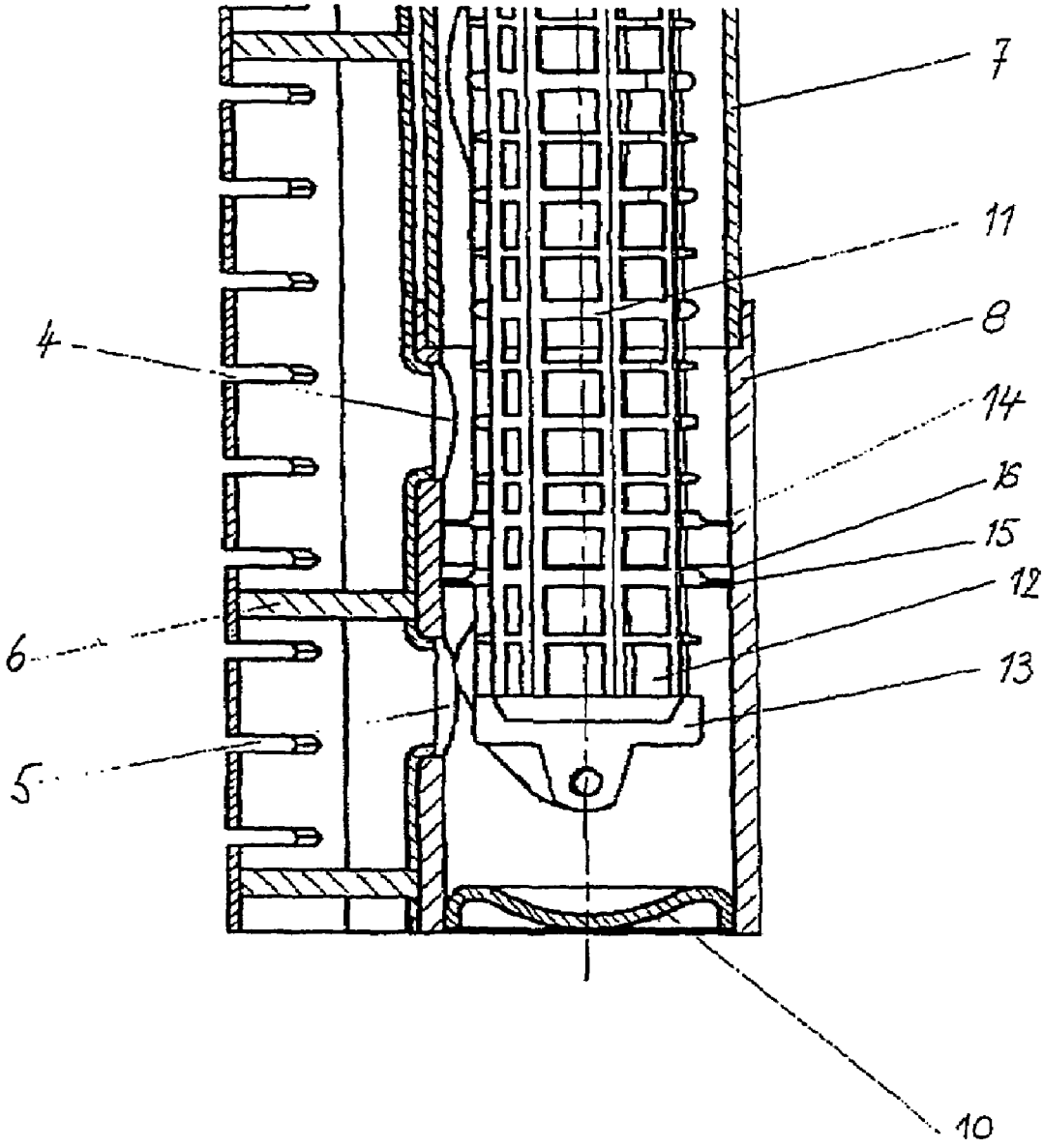
Figure 2A:
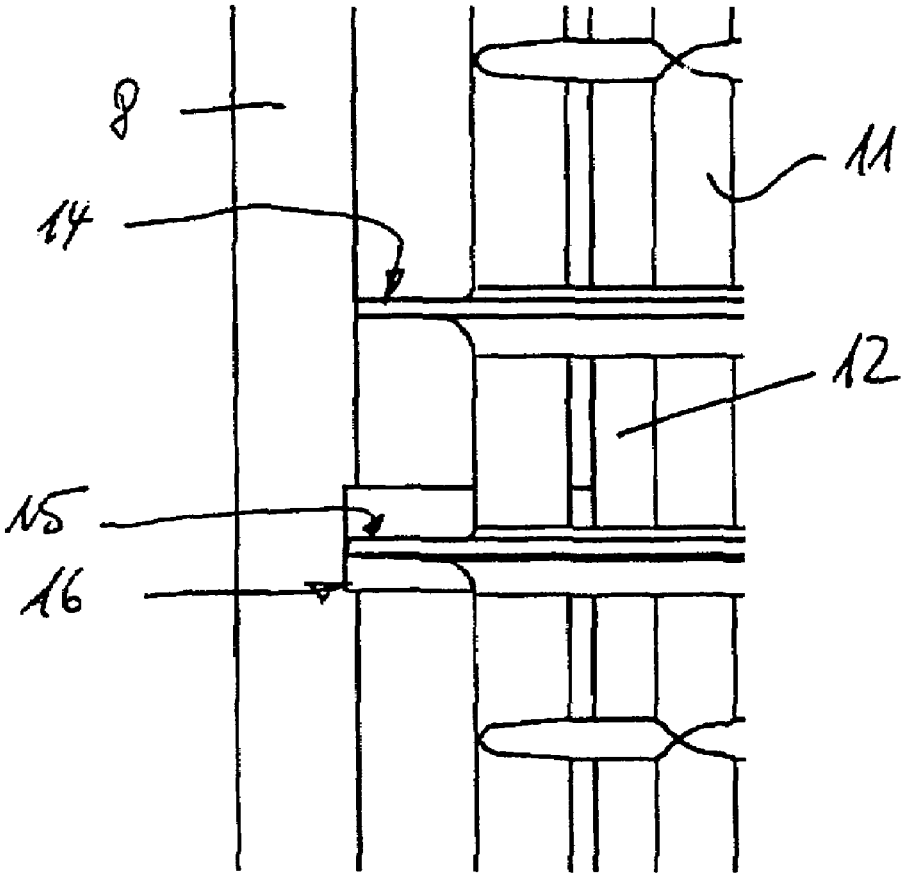
Figure 3:
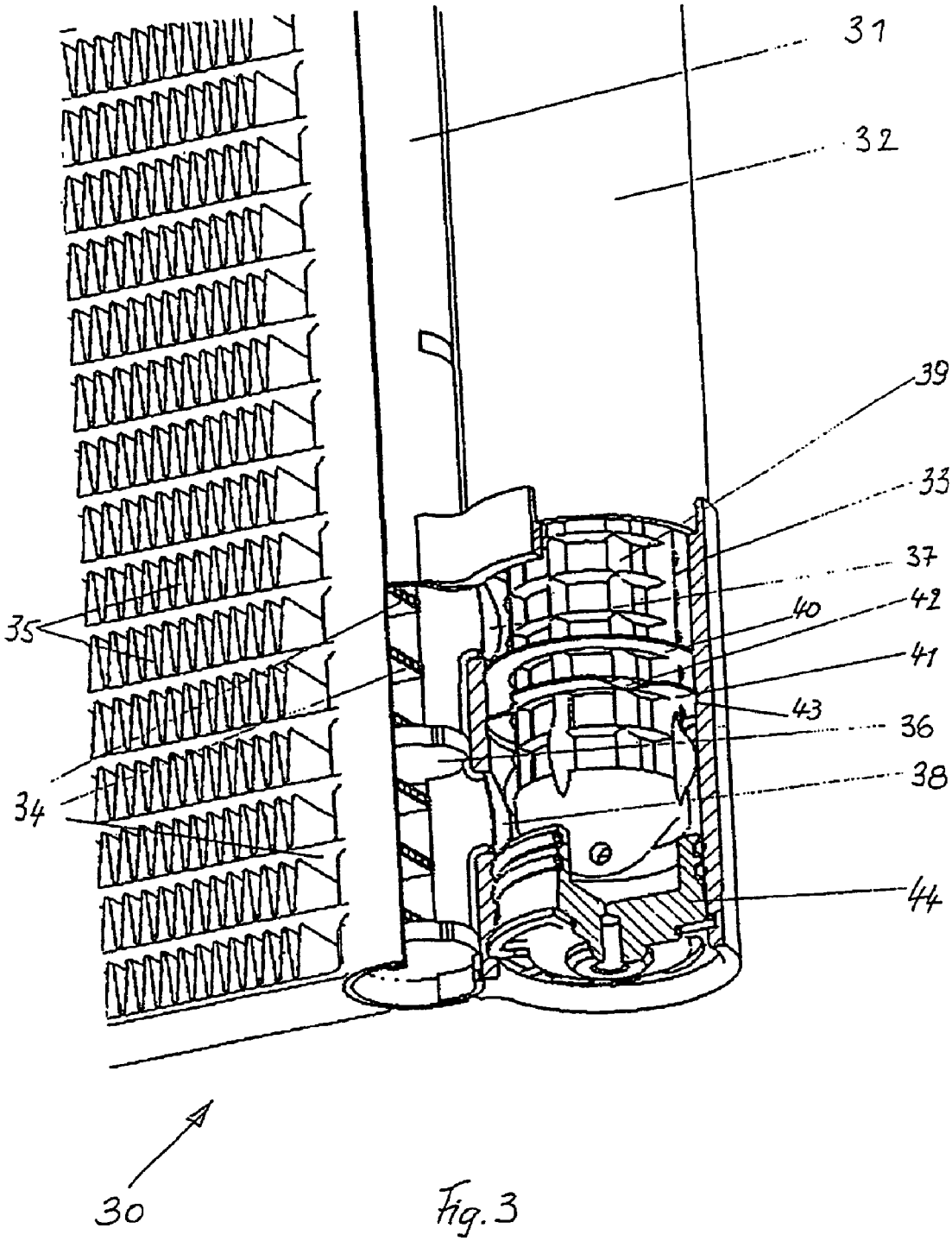
Figure 4:
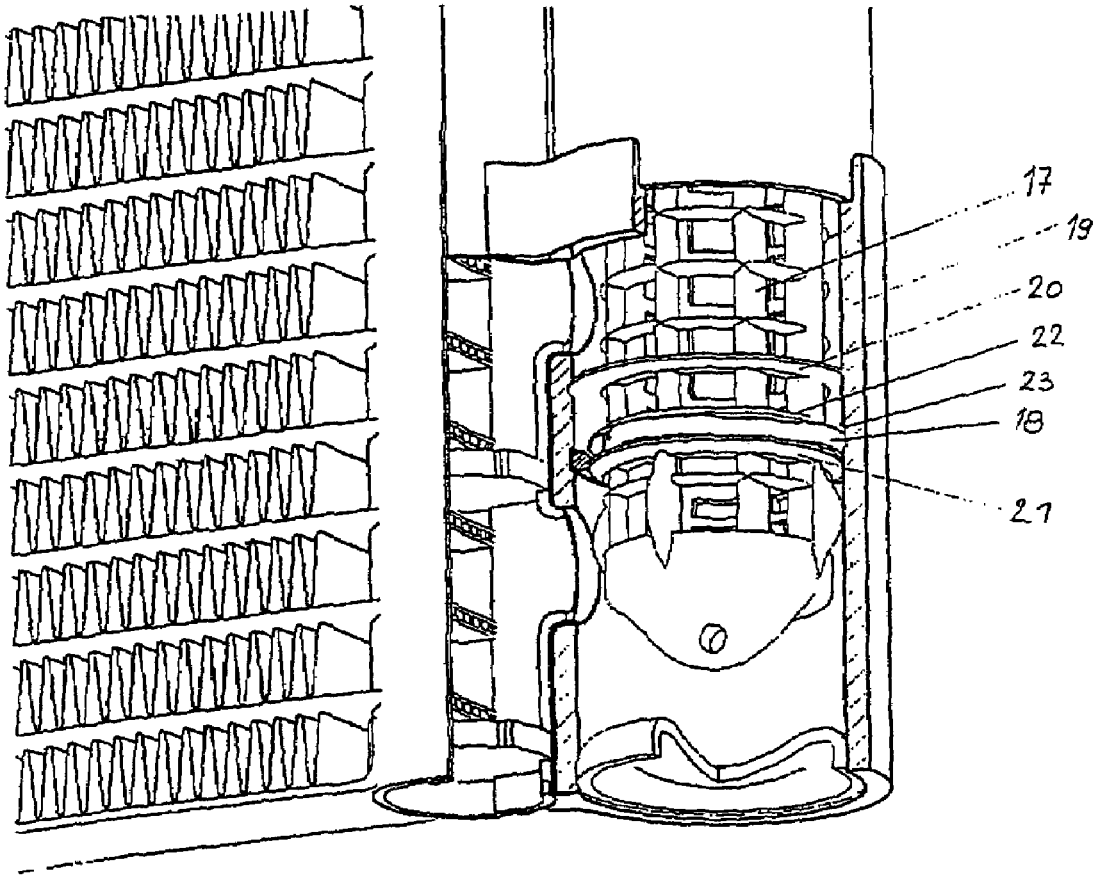
Figure 6:
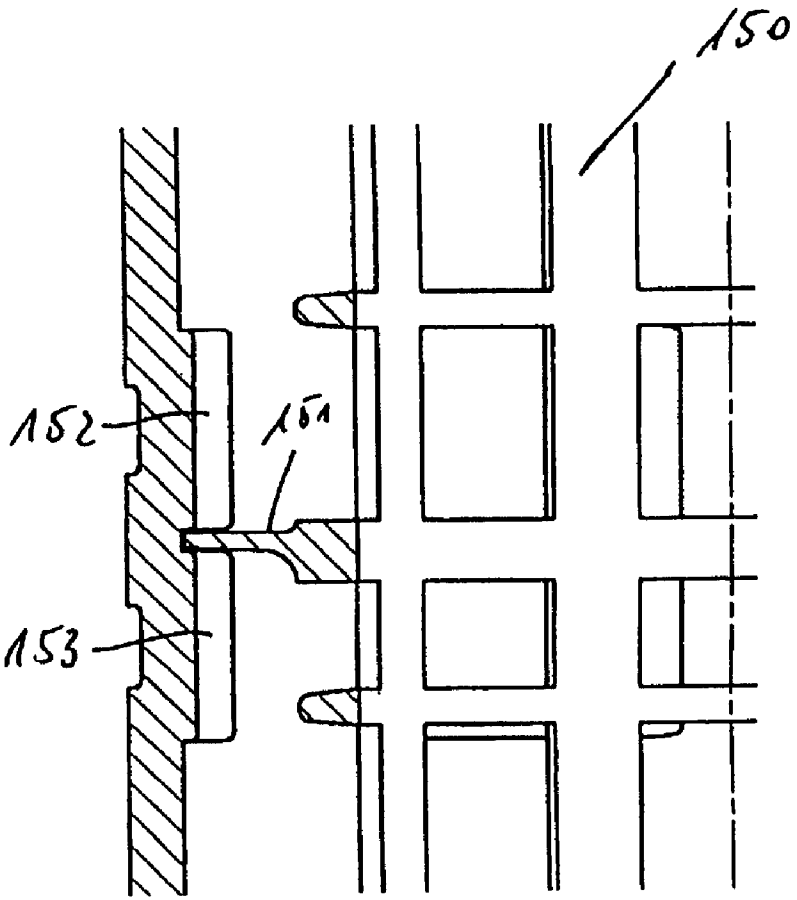
Figure 5:
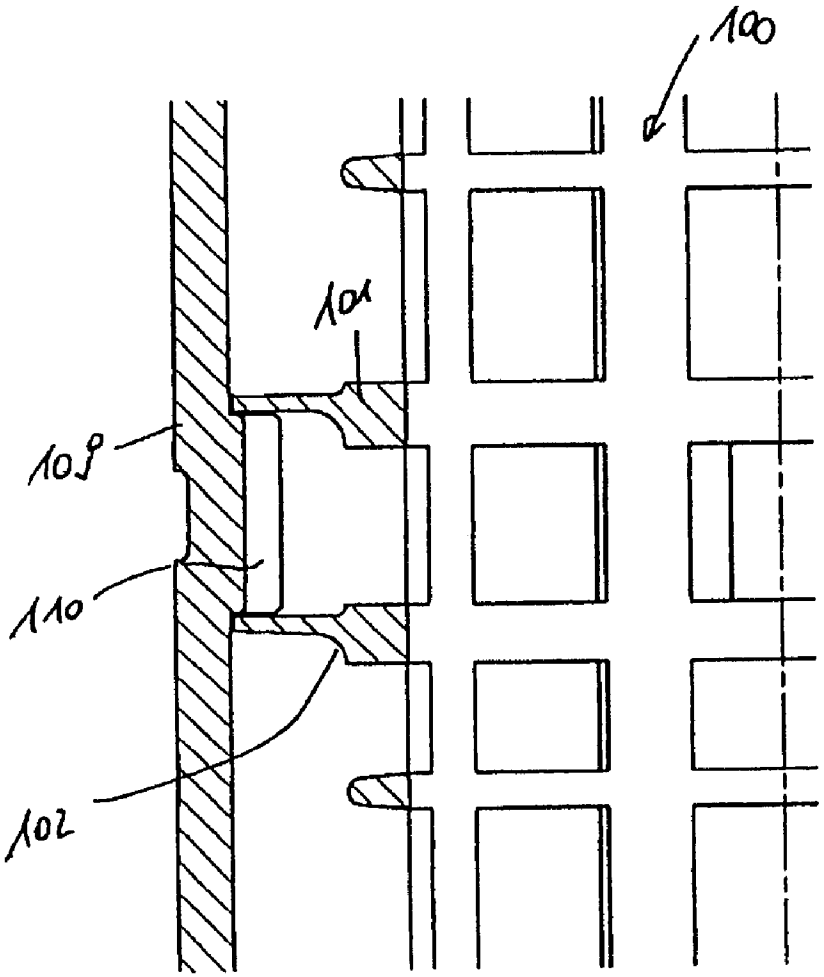
Figure 7:
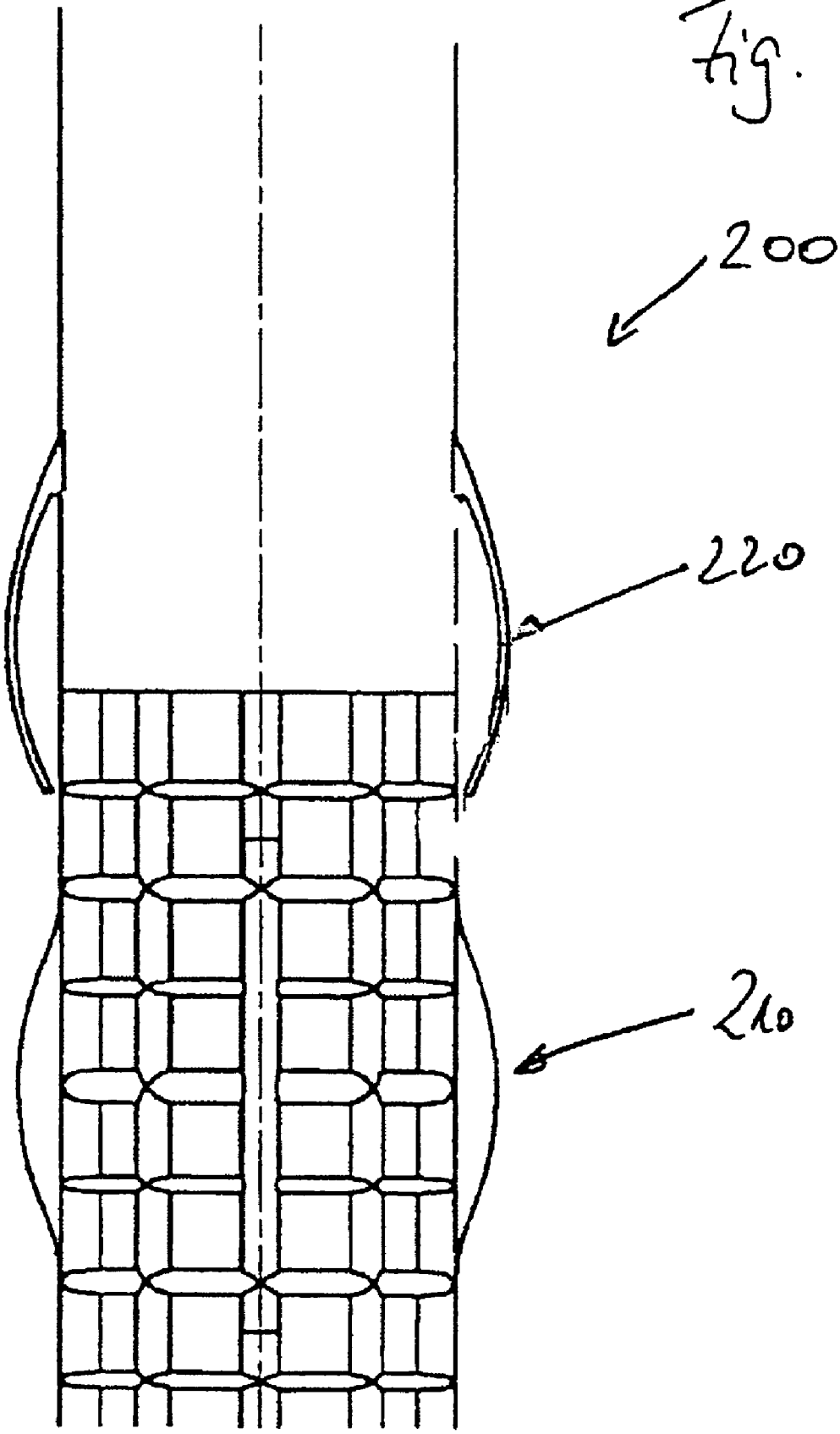

Exemplary embodiments of the invention are illustrated in the drawing and will be described in more detail below:

FIG. 1 shows a collector pipe with a collector, integrated to form one unit, FIG. 2 shows an enlarged portion X of the detail according to FIG. 1, FIG. 2*a* shows a detail of a collector, FIG. 3 shows a portion of a condenser with a detachable lid, FIG. 4 illustrates a securing means in the form of an annular spring element, FIG. 5 illustrates a securing means, FIG. 6 illustrates a securing means, and FIG. 7 illustrates a dryer/filter cartridge.

FIG. 1 shows a unit 1 composed of a collecting pipe 2 and a collector 3, for a condenser (not illustrated) of an air conditioning system for a motor vehicle. Such a unit, which is typical of a condenser module mentioned at the beginning, is the subject matter of the earlier patent application by the applicant with the file number DE 101 54 891 to which reference is hereby made and whose content is hereby expressly incorporated in the content disclosed by the present application. Collecting pipe 2 and collector 3 are connected to one another via two overflow openings 4 and 5 in a flow connection, a dividing wall 6 being arranged on the side of the collecting pipe 2 between these two openings 4 and 5. As a result, a forced flow of coolant is brought about through the collector from the condenser section of the condenser to a subcooling section of the condenser. The collector 3 which is of tubular design is composed of at least one tubular element. In the exemplary embodiment in FIG. 1, two pipe elements are provided, specifically an upper tubular element 7, which has relatively thin walls and is manufactured from a welded pipe and made of an extruded profiled element 8 which has thicker walls than the tubular element 7 and permits processing by cutting. The collector 3 is preferably sealed off in a pressure-tight fashion at its upper/lower end by a closure lid 9, and at its lower/upper end by a closure lid 10. In the interior of the collector 3 a dryer/filter cartridge 11 is arranged which is embodied as a single-piece or multi-component plastic injection molded part and has a plurality of openings 12 for the coolant to pass through. In the interior of the sleeve-like cartridge 11 there is a desiccant in the form of a granulate (not illustrated here) which draws moisture (water) from the coolant.

Since the cage-like sleeve of the dryer cartridge 11 is composed of plastic, it cannot be soldered simultaneously to the condenser, and instead the cartridge 11 is inserted, after the soldering process, into the collector 3 which is then open at one end, i.e. for example the closure lid 9 is still missing. After the cartridge 11 has been inserted and positioned in the collector 3, said collector 3 is finally closed off by soldering, welding or bonding the lid 9 to the collector 3. Alternatively, the lid 10 can also be inserted last.

FIG. 2 and FIG. 2*a* show the portion X from FIG. 1 and a further portion in an enlarged illustration. The dryer cartridge 11 has a bottom 13 which is located above the lower closure lid 10. The window-like openings 12 extend as far as the bottom region and are covered by a narrow mesh filter sieve (not illustrated), at least below the dividing wall 6 or below the lip 14, as a result of which particles located in the coolant are filtered or held back. A circumferential sealing lip 14 is attached to the plastic sleeve 11 by injection molding between the two overflow openings 4, 5; said sealing lip 14 prevents, in a known fashion, a flow around the cartridge 11 between the two overflow openings 4, 5. Arranged underneath the overflow opening 5 is an annular securing rib 15 which is of elastic design and is also attached to the plastic sleeve 11 by injection molding. The outer circumference of the securing rib 15 engages in an annular groove 16 which is formed in the inner wall of a pipe of the collector or an extruded profiled element 8. The securing rib 15 thus forms a positively locking connection, for example a click-in or latching connection, to the annular groove 16.

The cartridge 11 is installed in the collector 3 either from the upper or from the lower side of the collector 3, as already indicated above. The cartridge 11 is then pushed into the interior of the collector 3 until the securing rib 15, whose external diameter is preferably larger than the internal diameter of the collector 3 and is therefore elastically deformed, finally springs back when the annular groove 16 is reached and latches into the annular groove 16. As a result, the cartridge 11 is firmly positioned in the collector 3 by means of a latching connection. The missing closure lid is then inserted and nondetachably connected to the collector.

FIG. 3 shows a similar portion to that in FIG. 2 in a perspective illustration. The figure shows the lower corner of a condenser module 30 with a collecting pipe 31 and a collector 32 whose lower profiled element 33 is serrated, as is the lower region of the collecting pipe 31. Flat pipes 34, between which corrugated ribs 35 are arranged, open into the collecting pipe 31. The collecting pipe 31 is divided by a plurality of dividing walls, only one dividing-wall 36 of which can be seen here between the two overflow openings 37 and 38. A cage-like dryer/filter cartridge 39 is inserted into the collector 32, said cartridge 39 being injection molded from plastic, as already described, and having a circumferential sealing lip 40 and a securing rib 41 which is arranged at the circumference and is composed of individual segments distributed over the circumference, between which intermediate spaces 42 are formed. The segments of the securing rib 41 engage in an annular groove 43 which is formed in the profiled element 33. The collector 32 and its lower part, the profiled element 33, are detachably closed off by a closure stopper 44. Such a stopper closure has been disclosed, for example, by DE-A 199 43 422 by the applicant. The collector 32 can thus be opened and the dryer/filter cartridge 39 removed for maintenance purposes, and it is thus exchangeable.

FIG. 4 shows a modified exemplary embodiment with a dryer sleeve 17 which is positioned with respect to the profiled element 19 (lower part of the collector) by means of an annular spring element 18. The annular spring element 18 is a separate component made of spring steel or plastic and is slotted at its circumference so that it can experience radial spring compression. This annular spring element 18 is secured axially with respect to the dryer sleeve 17 by means of two annular ribs 21, 22 which lie one next to the other. A corresponding annular groove 23 is formed in the inner wall of the profiled element 19 and its dimensions correspond to the cross section of the annular spring element 18 and it can hold said element 18. The annular spring element 18 is mounted on the dryer sleeve 17 and is pushed with it, in a way analogous to that described above, into the collector until the annular spring element 18 reaches the groove 23, then springs back radially toward the outside and thus causes the dryer sleeve 17 to be locked with respect to the profiled element 19. The dryer sleeve 17 also has a circumferential sealing lip 20, as described above.

In a modification of the exemplary embodiments in FIGS. 2, 3 or 4 which is not illustrated, the securing means, that is to say the securing rib 15, 41 or the annular spring element 18, and the sealing means, that is to say the sealing lip 14, 40, 20 can be joined to form a combined holding and sealing means which is arranged between the two overflow openings.

Furthermore, in their embodiments described above, the securing means can be attached by injection molding to virtually any desired location with respect to the axial extent of the dryer sleeve: when they are arranged in the upper region, i.e. in the region of the thin-walled pipe, a bead which is formed in the pipe is a simple attachment possibility for the securing ribs.

FIGS. 5 and 6 show further securing possibilities of a dryer/filter element in a collector of a condenser.

In the exemplary embodiment in FIG. 5, the cartridge 100 has at least two elements 101, 102 which protrude in the radial direction and which hold a projection at least partially between them and thus keep the cartridge 100 positionally stable. The projections 101 and 102 preferably clamp the projection 110 between them. The projection 110 can be formed as a circumferential annular region or by individual projection-like elements. The region 110 can be embodied as a circumferential or segmented bead or as an arrangement of individual projections. The elements 101 and 102 may also be circumferential elements such as rings, or they may be formed by individual elements which lie opposite one another or which also do not lie opposite one another.

In the exemplary embodiment in FIG. 6, the cartridge 150 has at least one element 151 which protrudes in the radial direction and is held at least partially between two projections 152, 153 and as a result keeps the cartridge 100 positionally stable. The projections 152, 153 can be formed as a circumferential annular region or by individual projection-like elements. The element 151 can also be embodied as a circumferential element such as a ring, or it can be formed by individual elements, such as segmented elements.

A combination of the securing means of the exemplary embodiments described above is also possible.

FIG. 7 shows a region of the dryer/filter cartridge 200 which is arranged at a distance from the sealing ring and the securing element. In this region, spacer elements are provided so that the cartridge cannot wobble in the pipe of the collector but can also be secured in a centered fashion inside the pipe.

FIG. 7 shows two types of spacer elements, the spacer element 210 being an essential solid spacer element, and the spacer element 220 being an elastic or flexible spacer element. Depending on the exemplary embodiment, either only flexible spacer elements or only rigid spacer elements or a mixture of rigid and flexible spacer elements can be used.

The rigid spacer elements 210 are embodied as projection-like elements which are connected to the cartridge or are formed integrally with it. They project in the radial direction and can bear or be supported against the inner wall of the pipe of the collector. In the exemplary embodiment in FIG. 7, the spacer elements are constructed in the shape of circular segments, it being also possible to use a different shape.

The spacer elements 220 are of flexible design and according to the exemplary embodiment in FIG. 7 are embodied as an arm which is connected on one side to the cartridge, the other side being free. The arm is curved outwards and can adapt itself to the spatial situation owing to the flexibility of the arm. However, the arm is under a certain degree of stress or prestress so that the cartridge can also be held in such a way that it can also be centered in the pipe of the collector.

The spacer elements are distributed along the circumference of the cartridge and are preferably arranged at angular intervals of less than 180° up to more than 60°. This means that preferably three or more spacer elements are provided.

Instead of the spacer elements described above, an annular spacer element or a spacer element composed of spaced-apart pitch circle segments or circular segments can also be arranged.

The invention claimed is:

1. A condenser for a motor vehicle air-conditioning system, comprising:

a pipe/rib block with ribs and pipes, and collecting pipes which are arranged on either side of the pipes, wherein the collecting pipes hold the ends of the pipes, and a collector, which is arranged in parallel with one of the collecting pipes and which is fluidically connected to an adjacent collecting pipe via openings, comprises a closure part or is sealed off at each of the ends of the collector, wherein the collector holds a dryer cartridge and/or filter cartridge which is attached in the collector and has a circumferential sealing means which is arranged between the openings, wherein the dryer cartridge and/or filter cartridge can be attached in the collector by at least one securing means which is arranged at the circumference, wherein the at least one securing means is formed on the dryer cartridge and/or filter cartridge or is connected thereto, wherein the collector has at least one holding means into which the at least one securing means of the dryer cartridge and/or filter cartridge engages or interacts with it, and wherein the holding means is at least one depression in the collector, wherein the depression is at least partially circumferential.

2. The condenser as claimed in claim 1, wherein both closure parts are nondetachably connected to the collector, or both ends are nondetachably closed off.

3. A condenser, for a motor vehicle air-conditioning system, comprising:

a pipe/rib block and collecting pipes which are arranged on either side of the pipe/rib block and hold the ends of the pipes, and a collector which is arranged in parallel with one of the collecting pipes, wherein the one collecting pipe is adjacent to the collector, wherein the collector is fluidically connected to the adjacent collecting pipe via openings, wherein the collector has at the ends at least one detachable closure part or in each case one detachable and one nondetachable closure part, wherein the collector holds a dryer/filter cartridge which is attached in the collector and has a circumferential sealing means which is arranged between the openings, wherein the dryer/filter cartridge can be attached or secured in the collector by at least one securing means which is arranged at the circumference, wherein the at least one securing means is formed on the dryer cartridge and/or filter cartridge or is connected thereto, wherein the collector has at least one holding means into which the at least one securing means of the dryer cartridge and/or filter cartridge engages or interacts with it, and wherein the holding means is at least one depression in the collector, wherein the depression is at least partially circumferential.

4. The condenser as claimed in claim 1, wherein a plurality of securing means are provided.

5. The condenser as claimed in claim 1, wherein the securing means comprises at least one circumferential rib.

6. The condenser as claimed in claim 1, wherein the securing means comprises at least one multi-component, interrupted rib.

7. The condenser as claimed in claim 1, wherein the securing means is embodied in such a way that one or more projections or protrusions are provided.

8. The condenser as claimed in claim 1, wherein the securing means comprises a plurality of rib segments distributed over the circumference.

9. The condenser as claimed in claim 1, wherein the dryer cartridge and/or filter cartridge comprises at least one securing means into which the at least one securing means of the collector engages.

10. The condenser as claimed in claim 1, wherein the securing means or holding means is at least one projection or a plurality of projections in the collector.

11. The condenser as claimed in claim 1, wherein the securing means or holding means is a plurality of at least partially circumferential projections in the collector.

12. The condenser as claimed in claim 1, wherein the holding means comprises at least one or more depressions in the collector.

13. The condenser as claimed in claim 1, wherein the collector is formed from a tubular element and an extruded profiled element.

14. The condenser as claimed in claim 1, wherein the collector is formed from an extruded profiled element.

15. The condenser as claimed in claim 1, wherein the depression is embodied as an annular groove.

16. The condenser as claimed in claim 10, wherein the depression or projection comprises a bead.

17. The condenser as claimed in claim 1, wherein a plurality of depressions or projections are provided.

18. The condenser as claimed in claim 1, wherein the securing means comprises an annular spring element which is secured to the dryer/filter cartridge at one end and engages in the depression at the other.

19. The condenser as claimed in claim 1, wherein the securing means is arranged between the openings.

20. The condenser as claimed in claim 1, wherein the securing means and the sealing means are formed by a circumferential lip which is arranged between the openings.

21. A method for manufacturing a condenser as claimed in claim 1, comprising:

first brazing an assembly comprising the pipe/rib block, collecting pipes, collector and only one closure part, to provide an open end side, inserting a premounted dryer/filter cartridge into the collector through the open end side and securing the dryer/filter cartridge in the collector by the latching means, and closing off the collector in a nondetachable or detachable fashion by insertion of a second closure part.

* * * * *